US008308137B2

(12) United States Patent
Alles

(10) Patent No.: US 8,308,137 B2
(45) Date of Patent: Nov. 13, 2012

(54) REMOTE CONTROLLED VEHICLE FOR THREADING A STRING THROUGH HVAC DUCTS

(75) Inventor: Harold Gene Alles, Lake Oswego, OR (US)

(73) Assignee: EMME E2MS, LLC, Bristol, CT (US)

( * ) Notice: Subject to any disclaimer, the term of this patent is extended or adjusted under 35 U.S.C. 154(b) by 878 days.

(21) Appl. No.: 12/240,737

(22) Filed: Sep. 29, 2008

(65) Prior Publication Data

US 2010/0081357 A1 Apr. 1, 2010

(51) Int. Cl.
*H02G 1/08* (2006.01)
*B61B 13/10* (2006.01)

(52) U.S. Cl. ..... 254/134.3 FT; 104/138.2; 254/134.5

(58) Field of Classification Search ..... 254/134.3 R, 254/134.5, 134.3 FT; 104/138.2
See application file for complete search history.

(56) References Cited

U.S. PATENT DOCUMENTS 4,253,697 A * 3/1981 Acosta ..... 294/115
5,020,188 A 6/1991 Walton
5,072,487 A 12/1991 Walton
5,317,782 A * 6/1994 Matsuura et al. ..... 15/324
5,377,381 A 1/1995 Wilson
5,528,789 A 6/1996 Rostamo
5,561,883 A * 10/1996 Landry et al. ..... 15/302
5,736,821 A * 4/1998 Suyama ..... 318/16
5,901,651 A * 5/1999 Boyd ..... 254/134.5
6,786,473 B1 9/2004 Alles
6,983,889 B2 1/2006 Alles
6,997,390 B2 2/2006 Alles
7,062,830 B2 6/2006 Alles
7,162,884 B2 1/2007 Alles
7,188,779 B2 3/2007 Alles
7,392,661 B2 7/2008 Alles
2006/0284149 A1 * 12/2006 Watkins ..... 254/134.5
2010/0081372 A1 4/2010 Alles

* cited by examiner

*Primary Examiner* — Hadi Shakeri

(57) ABSTRACT

The invention is a remote controlled vehicle adapted for navigating inside HVAC supply trunks. It is equipped with a moveable camera and a powered tool for snagging a string or parachute propelled into the trunk by other methods. A command box is provided to view the image from the camera and control the vehicle's various functions. The installation technician inserts the vehicle into the trunk through an access hole and uses the command box to navigate the vehicle inside a HVAC trunk and locate and secure the string to the vehicle. The technician then controls the vehicle to pull the string back to the access or the technician manually pulls the vehicle back to the access by its tether.

8 Claims, 10 Drawing Sheets

REMOTE CONTROLLED VEHICLE FOR THREADING A STRING THROUGH HVAC DUCTS

BACKGROUND OF THE INVENTION

1. Technical Field of the Invention

This invention relates generally to HVAC zone control systems for retrofit, and specifically to a remote controlled vehicle to assist in threading string, air tubes, and wires through concealed HVAC duct systems.

2. Background Art

Most zone control systems for HVAC systems use electromechanical dampers to selectively control the airflow through portion of the trunk and duct system. Installation of these zone systems requires access to the ducts at multiple locations so that the dampers can be installed. Although the duct is accessible for damper installation, there may be no easily accessible path to run control wires from the damper to the control system because portions of the duct may be enclosed in walls, floors, or ceilings. However the duct system does provide a clear path provided the zone control equipment is located near the HVAC equipment. The existing ductwork can be used as a conduit for running the control wires, but this requires a practical method for threading the wire from the damper to the HVAC equipment.

U.S. Pat. No. 6,786,473 issued Sep. 7, 2004 to Alles, U.S. Pat. No. 6,893,889 issued Jan. 10, 2004 to Alles, U.S. Pat. No. 6,997,390 issued Feb. 14, 2006 to Alles, U.S. Pat. No. 7,062,830 issued Jun. 20, 2006 to Alles, U.S. Pat. No. 7,162,884 issued Jan. 16, 2007 to Alles, U.S. Pat. No. 7,188,779 issued Mar. 13, 2007 to Alles, and U.S. Pat. No. 7,392,661 issued Jul. 1, 2008 to Alles, describes various aspects of a HVAC zone climate control system that uses inflatable bladders. The present invention is by the same inventor and is designed to assist in the installation of this system.

The system invented by Alles has multiple inflatable bladders installed in the supply ducts such that the airflow to each vent can be separately controlled by inflating or deflating the bladder in its supply duct. Each bladder is connected to an air tube that is routed through the duct and trunk system back to a set of centrally located computer controlled air valves that can separately inflate or deflate each bladder. Based on temperature readings from each room and the desired temperatures set for each room, the system controls the heating, cooling, and circulation equipment and inflates or deflates the bladders so that the conditioned air is directed where needed to maintain the set temperatures in each room.

U.S. Pat. No. 7,062,830 issued Jun. 20, 2006 to Alles describes a method of installing the air tubes. This method uses air flow from the vent toward the HVAC equipment to pull a parachute and thin string from the vent to the HVAC equipment. At the HVAC equipment, an air tube is connected to a string and the string is pulled toward the vent until the air tube reaches the vent. This method requires all vents but one be blocked so that all of the airflow generated by a blower at the HVAC system comes from one vent. This method works well for many duct systems and specific duct paths. However, this method does not work well for some duct systems and specific duct paths.

Excessive duct leakage can prevent this method from working. With all vents sealed but one, all of the airflow generated by the blower should flow through the one open vent. However, the airflow can also come for all of the leaks in the duct system. If the leakage is excessive, there is insufficient airflow at the vent to inflate and pull the parachute.

Small supply ducts at the vent in the range of 4" to 6" in diameter can prevent this method from working even with strong airflow. In a small vent, a large portion of the parachute is in contact with the walls of the duct creating a large drag, and screws or sharp edges are likely to snag the parachute. In addition, the airflow in the small cross-section area produces only a small force on the parachute. Increasing the air flow to increase the pulling force also increases the drag since parts of the parachute are pushed harder against the duct walls. The combination of high drag and small force makes it difficult for the parachute to pass through the duct.

If a smaller parachute is used for smaller ducts, it is often easier for the parachute to pass through the duct. However, the small duct eventually connects to a larger duct or main supply trunk. As the duct cross-section increases, the air velocity decrease and the small parachute can not product enough force to pull the string to the HVAC equipment.

In some duct networks with long duct runs with many turns, the resistance between the string and the duct walls become excessive as the length of the string being pulled increases. The force generated by the parachute is not sufficient to overcome the string pulling friction.

Patent application 12240570 discloses a method that overcomes some of these limitations. It discloses methods for propelling a string through a small duct to a larger trunk and separate methods for retrieving the string in the trunk and pulling it to an access cut into the trunk near the HVAC equipment.

A specially adapted remote controlled vehicle can be used to capture and retrieve a string in a trunk. Small remote controlled vehicles are produced in various sizes and styles for the toy and hobbyist market. Their design and function are understood by those skilled in the art. However, they are not adapted for use in HVAC trunks and for the purpose of capturing a string or parachute.

U.S. Pat. No. 5,020,188 issued Jun. 4, 1991 and U.S. Pat. No. 5,072,487 issued Dec. 17, 1991 to Walton discloses a vehicle adapted for traveling inside HVAC ducts and spraying liquids to clean the ducts. It was guided by the duct wall and had no provisions for remote steering. It did not provide video camera and display for showing the inside of the ducts as it traveled.

U.S. Pat. No. 5,317,782 issued Jun. 7, 1994 to Matsuura discloses a remote controlled tracked vehicle adapted for traveling inside HVAC duct and cleaning ducts. It included a video camera fixed to the body of the vehicle and a remote display for viewing the image. It also included a swiveling air jet for blowing debris from the duct wall. The vehicle followed the walls of the duct and provided no method for remote controlled steering.

U.S. Pat. No. 5,377,381 issued Jan. 3, 1995 to Wilson describes a vehicle adapted for traveling inside HVAC ducts and cleaning the ducts. It had specialized tools for spraying and brushing. It did not have the ability make controlled turns since it was designed to be guided by the duct walls. It did not provide video camera and display for showing the inside of the ducts as it traveled.

U.S. Pat. No. 5,528,789 issued Jun. 25, 1996 to Rostamo discloses a remote controlled tracked vehicle adapted for cleaning ducts. The vehicle could be steered remotely and could be maneuvered independent of the duct walls. It included a video camera fixed to the body of the vehicle with a lighting system so the inside of the ducts could be viewed on a remote display. It also included a rotating brush powered by air pressure that could be raised and lowered by remote control.

The remote controlled vehicles of the previous art for use in HVAC duct were adapted for cleaning. Thus they were relatively large to support the weight and stress caused by the cleaning apparatus and process. They required a compressed air source to power the cleaning apparatus. They were too large to fit in many trunks routinely used in residential HVAC systems. They did not have a moveable tool adapted to capture string or a moveable video camera adapted to searching for string.

OBJECTS OF THIS INVENTION

An object of this invention is to provide a remote controlled vehicle to assist in threading a string through an HVAC duct system from a vent to the HVAC equipment where a small duct supplies the vent and the small duct is connected to a large supply trunk connected to the HVAC supply plenum.

Another object is to provide a remote controlled vehicle to assist in threading string in a HVAC duct system that is smaller, less expensive, and more functional than the prier art.

Another object is to provide a remote controlled vehicle to assist in threading string such that the installation labor is less and more predictable for a wider variety of duct systems than the methods of the prier art.

SUMMARY

The invention is a tethered remote controlled vehicle adapted for navigating and maneuvering inside HVAC supply trunks. It is equipped with a moveable camera and a powered tool for snagging a string or parachute propelled into the trunk by other methods. A command box is provided to view the image from the camera and control the vehicle's various functions. The installation technician inserts the vehicle into the trunk from an access hole and uses the command box to navigate and maneuver the vehicle inside a HVAC trunk and locate and secure the string to the vehicle. The technician then controls the vehicle to pull the string back to the access or the technician can manually pull the vehicle back to the access by its tether.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

Figure 1:
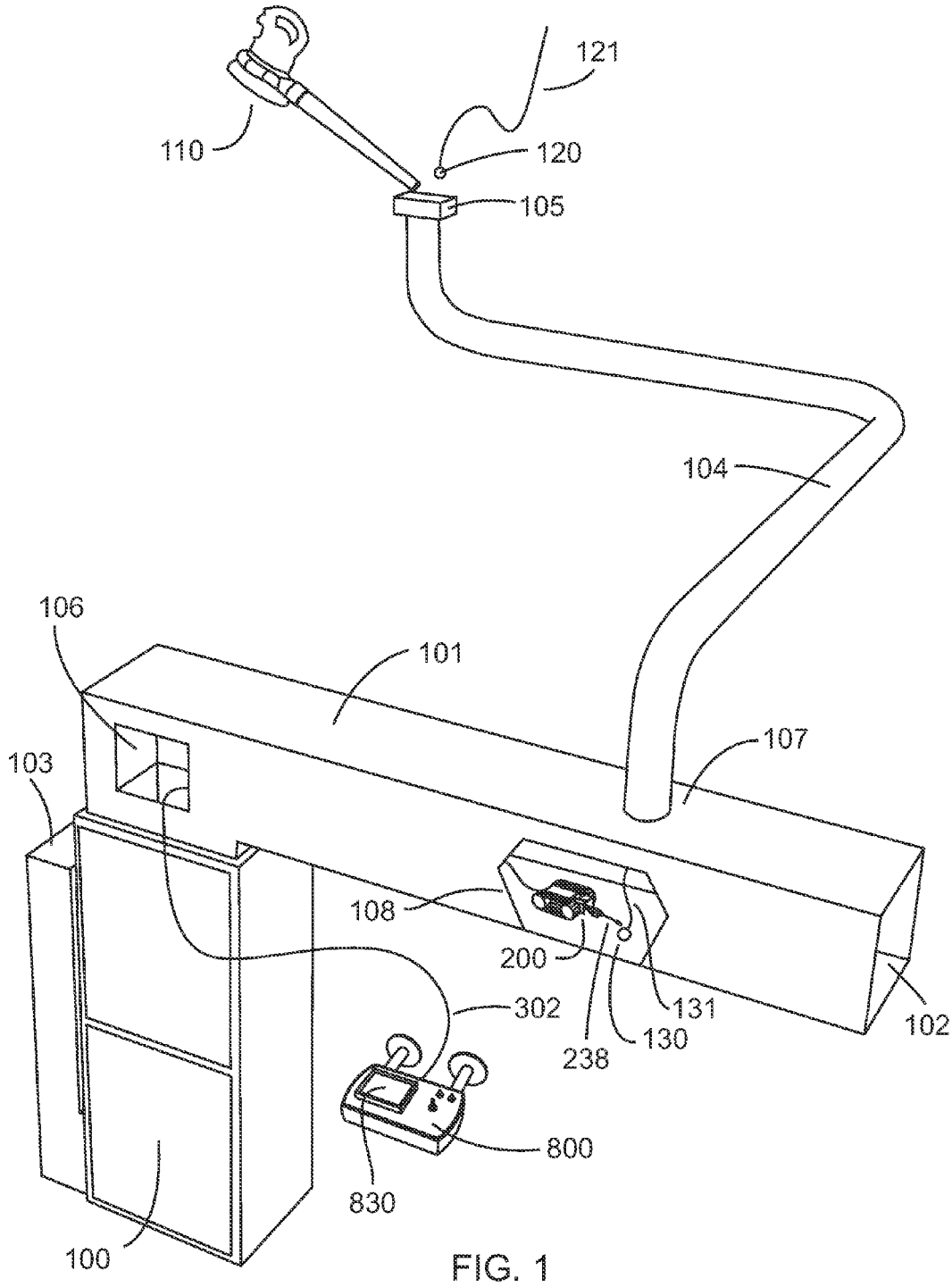
FIG. 1 is a perspective view of a HVAC system with tools for threading a string.

FIG. 1 is a perspective view of a typical HVAC system found in residential dwellings. HVAC equipment 100 includes a fan for generating a flow of warmed or cooled air through a network of supply ducts that distribute the air through out the dwelling. The duct network includes a main trunk 101 connected to the supply plenum of the HVAC equipment 100. Only a small section of the main trunk is shown. The open end 102 is connected to the remainder of the duct network. A smaller duct 104 connects to the main trunk at 107 and provides a path for airflow to vent 105. There are one or more vents in each room of the dwelling. Each of the other vents is connected to a smaller duct that also connects to the main trunk. Dwellings typically have 10 to 30 vents; only one vent of many is shown in FIG. 1. Air is returned to the HVAC equipment through duct 103 which is connected to one or more large centrally located return vents in the dwelling. In many dwellings, the duct network is enclosed by walls, floors, and or ceilings. Easy access is only available at the vents and at the supply plenum. An access hole 106 cut in the supply plenum near the HVAC equipment provides access to the interior of the main trunk 101.

A portion of the installation process requires threading a string from vent 105 through duct 104 and trunk 101 to access 106. The threading is accomplished in two steps. First a small light object 120 connected to string 121 is propelled through the duct 104 using high velocity blower 110. Typically the object 120 is a ball made from expanded polystyrene foam. This step propels the object 120 and string 121 through duct 104 through joint 107 into trunk 101. A visual cutout 108 in trunk 101 provides a view inside the trunk. Object 130 and string 131 represent object 120 and string 121 after being propelled through duct 104.

Remote controlled vehicle 200 is connected via tether 302 to the command box 800. The vehicle 200, tether 302, and command box 800 are the subject of this invention. The installation technician inserts the vehicle into trunk 101 through access 106 and uses the command box to control the vehicle, navigating it through trunk 101 until it reaches object 130 near joint 107. A video camera on the vehicle sends an image to the display 830 on the command box so the technician has a view of the inside of the duct. The technician commands the snag tool 238 to rotate while the vehicle is maneuvered near string 131. After the snag tool captures the string, the technician can navigate the vehicle back to the access 106, pulling the string along. Alternately the technician can use the tether 302 to pull the vehicle back to the access with the string.

Figure 2:
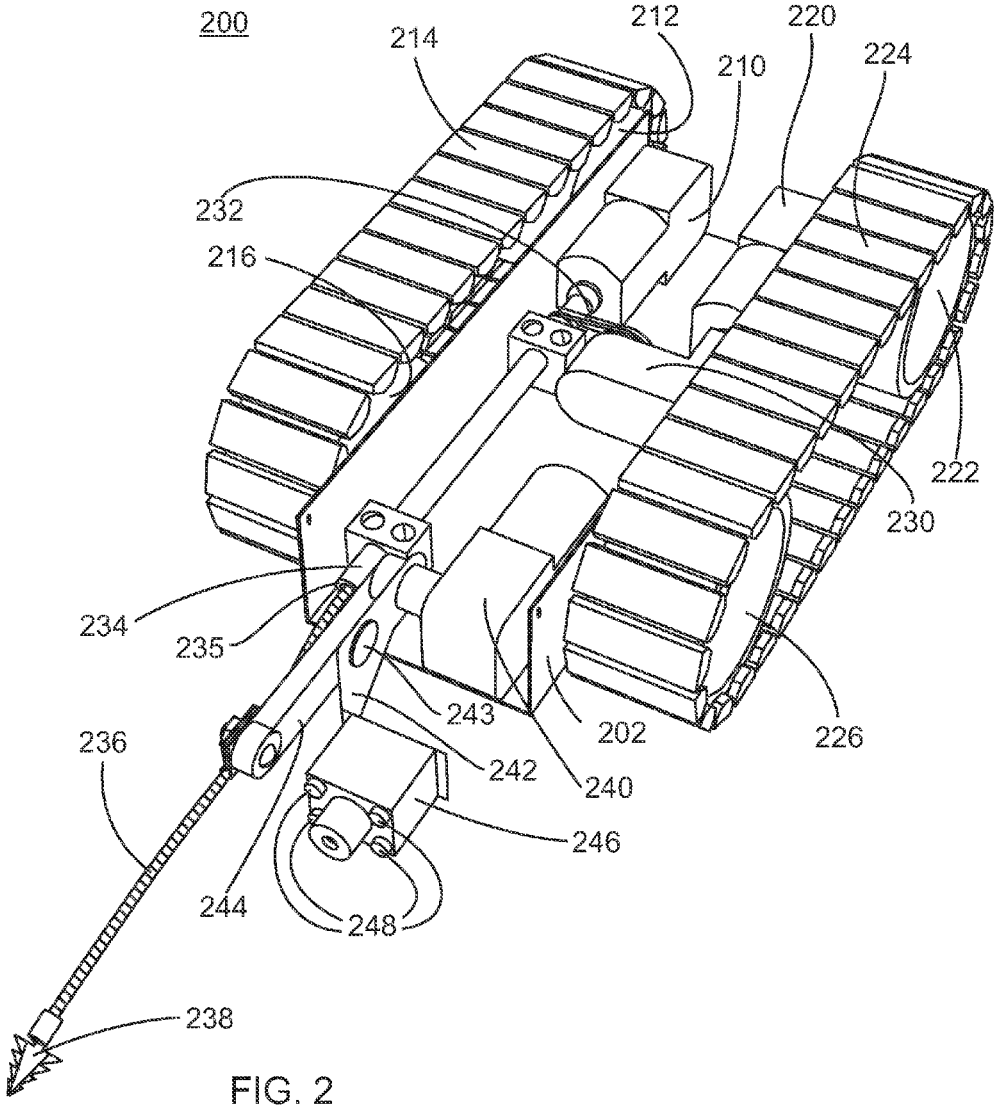
FIG. 2 is a perspective view of the vehicle with its cover removed.

FIG. 2 is a perspective diagram of the vehicle with the top cover removed. The overall size of the preferred embodiment enables it to navigate inside a 7" round duct. The central structure of the vehicle is the U-shaped chassis 202 bent from sheet metal. The right side of the vehicle is propelled by the right gear motor 210 connected to drive wheel 212 which engages right track 214. Idler wheel 216 is connected to chassis 202 and guides right track 214 along the right side of the chassis. The left side of the vehicle is propelled by the left gear motor 220 connected to drive wheel 222 which engages left track 224. Idler wheel 226 is connected to chassis 202 and guides left track 224 along the left side of the chassis. Tracks are preferred over wheels because they maximize traction to the duct surface and provide high maneuverability. Several manufactures serving the hobby robot market provide suitable track and motor systems. For example, Solarbotics Ltd., 201 35.sup.th. Ave. NE, Calgary, AB T2E 2K5 supplies "Gear Motor 3" that is suitable for gear motors 210 and 220. They also provide "Gear Motor Tread Cogs", "Gear Motor Tread Links", and "Gear Motor Tread Idlers" that are suitable for right track elements 212, 214, and 216 respectively and for left track elements 222, 224, and 226 respectively.

The snag gear motor 230 provides the drive for the snag fixture 238. A suitable gear motor is supplied by the aforementioned Solarbotics as "Gear Motor 6". O-ring belt 232 transfers rotation from motor 230 to drive tube 234 and flexible shaft 236 connected to snag fixture 238. The drive tube 234 allows the flexible shaft to slide in and out of the drive tube. End cap 235 on the drive tube 234 limits the travel of the flexible shaft so it can not be pulled out of the drive tube. The outer surface of the flexible shaft has a spiral wrap of wire that creates a fine-pitched shallow thread. This thread is used to create a force to move the flexible shaft as it is rotated. The rotation motion provided by motor 230 causes the snag fixture 238 to extend or retract depending on the direction rotation.

The camera gear motor 240 rotates the camera arm 242 and snag arm 244. A suitable gear motor is supplied by the aforementioned Solarbotics as "Gear Motor 3". Camera arm 242 supports camera 246 and LEDs (light emitting diodes) 248. The camera arm has a range of rotation of about 170 degrees. Downward rotation is limited by camera arm 242 interfering with chassis 202. Upward rotation is limited by camera 246 interfering with camera motor 240. When fully rotated upward, the camera provides a reward view that is used when navigating the vehicle backwards.

Snag arm 244 controls the elevation of the flexible shaft 236. The snag arm 244 is free to rotate about the axis of the drive shaft of camera motor 240, independent of the camera arm. However, the stiffness of flexible shaft 236 limits the range of rotation of snag arm 244 to about 45 degrees above and below the axis of the drive tube 234. Magnet 243 provides a "sticky-coupling" between camera arm 242 and snag arm 244. The magnet couples the snag arm to the camera arm for limited up and down rotation of the camera arm. If the camera arm is rotated more than about 45 degrees upward, the magnet will release the snag arm. The camera arm can then rotate upward to its maximum rotation. The snag arm position is then determined by the stiffness of flexible shaft. As the camera arm is rotated fully down, the magnet again couples the camera arm and the snag arm. The downward rotation of the snag arm is limited by the flexible shaft pressing against the bottom duct surface. As the camera arm rotates fully down, the magnet slips so that the camera arm and snag arm become approximately aligned. This sticky-coupling enables the camera motor to control the elevation of both the camera and snag tool while allowing a larger range of rotation for the camera.

Figure 3:
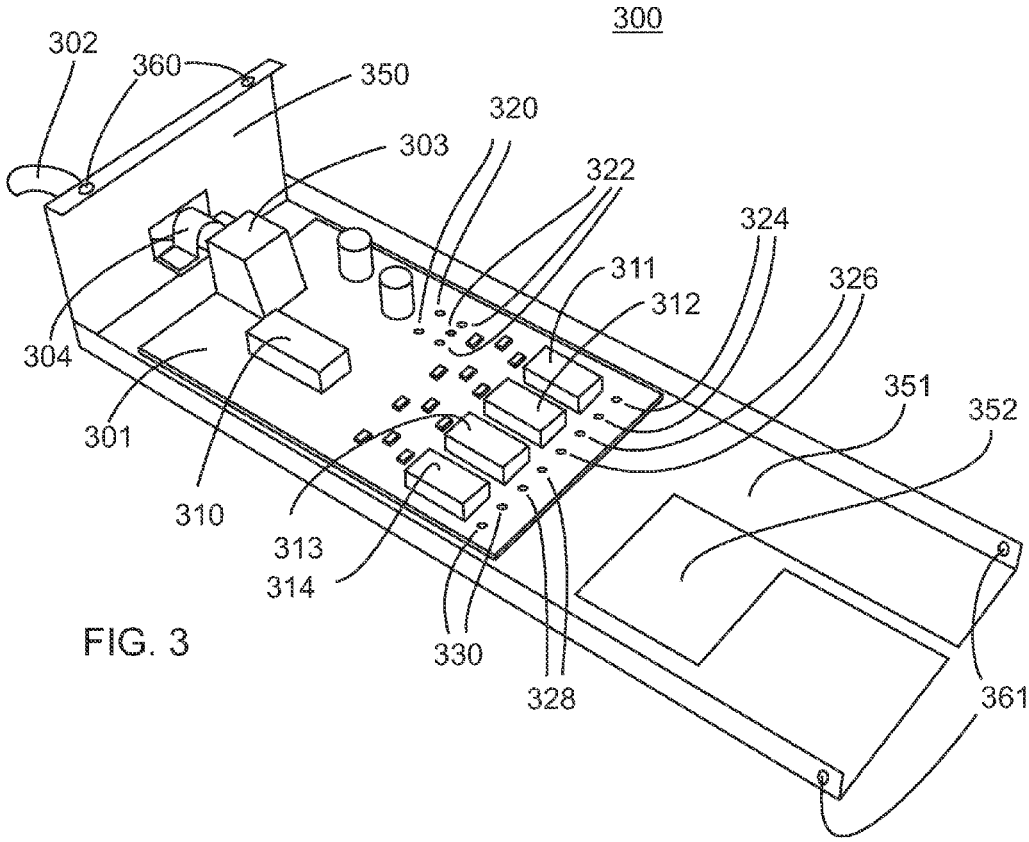
FIG. 3 is a perspective view of the vehicle top with circuit board attached.

FIG. 3 is a perspective diagram of the vehicle top cover 300. The vehicle PCB (printed circuit board) 301 contains the vehicle control circuits and is attached to cover 300. PCB 300 has connector 303 for connecting to tether 302. In the preferred embodiment the tether is standard 50 foot length of 8-conductor CAT-5 cable with factory installed connectors on both ends. These cables are available through multiple retail and wholesale stores and are typically used to make connections to an Ethernet. These cables are flexible, have a sufficient number of conductors and current carrying capacity, and are sufficient strong and durable for use in a HVAC duct system. The tether 302 is secured to end 350 of top 300 by strain relief 304. The strain relief transfers pulling forces on tether 302 to top 300 without straining the tether connection with connector 303.

The primary components of the vehicle control circuit are the microprocessor 310 and H-bridge motor drive ICs (integrated circuits) 311 for the right motor, 312 for left motor, 313 for camera motor, and 314 for snag motor. The PCB 301 has connection points for the vehicle components. These connections are made by soldering wires connected to the components to the connection points. Connection points 320 connect to LEDs 248 shown in FIG. 1. Connection points 322 connect to camera 246 shown in FIG. 1. Two of these connection points provide power and ground to the camera and the third connection point connects to the camera video output. Connection points 324 connect to right motor. Connection points 326 connect to the left motor. Connection points 328 connect to camera motor. Connection points 330 connect to snag motor.

Surface 351 of top 300 covers the top of chassis 202 of the vehicle shown in FIG. 1. Cut out area 352 provides clearance for the camera 246 and camera arm 242 to rotate upward until the camera touches the top of camera motor 240. Clearance holes 360 are for screws that attach to the bottom of chassis 202. Clearance holes 361 are for screws that attach to the side of chassis 202.

Figure 4:
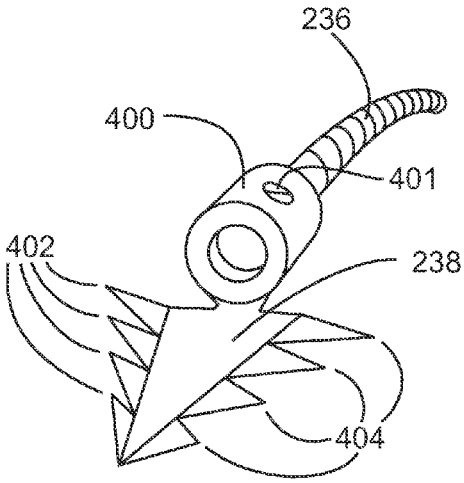
FIG. 4 is a perspective of the snag fixture.

FIG. 4 is a perspective view of the snag fixture 238. The fixture is cut from flat sheet metal and formed to fit around collar 400 and attached using solder or adhesive. Collar 400 attaches to flexible shaft 236 by set screw 401. Points 402 are bent up from the plane of 238 by about 20 degrees. Points 404 are bent down from the plane of 238 by about 20 degrees. Rotating the flexible shaft clock wise (when view from the front) tends to cause causes the points to capture string or parachute material. The string or parachute wraps around 238 as it rotate, creating a strong connection between the snag fixture and the string or parachute material.

Figure 5:
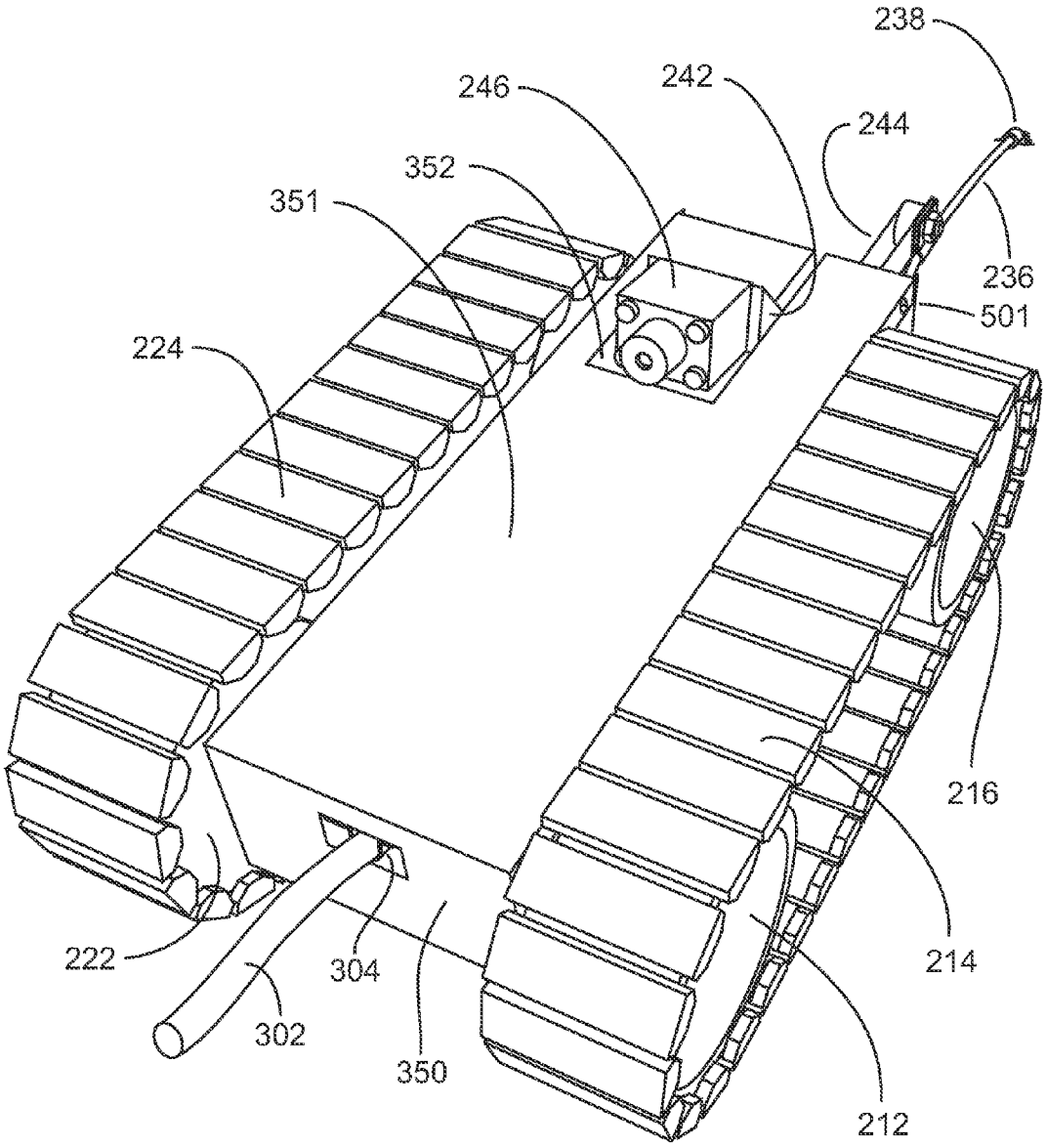
FIG. 5 is a perspective view of the complete vehicle with the camera positioned for rear view.

FIG. 5 is a perspective view from the rear of the vehicle 200 with the top 300 attached. Four sheet metal screws pass through holes 360 and 361 shown in FIG. 3 and engage with the surfaces of chassis 202 shown in FIG. 2. Only screw 501 is visible in this view. Top surface 350 covers the back of the vehicle. Strain relief 304 secures tether 302 to the surface 350. Surface 351 covers the top of the vehicle. The camera 246 is fully rotated upwards so that it provides a view toward the rear. Cut out 352 provides clearance for the camera and camera arm 242. The elevation of the snag arm 244 is determined by the flexibility of the flexible shaft 236, its length of extension, and the weight of snag fixture 238. Visible components of the right side drive include drive wheel 212, track 214, and idle wheel 216. Visible components of the left side drive include drive wheel 222 and track 224.

Figure 6:
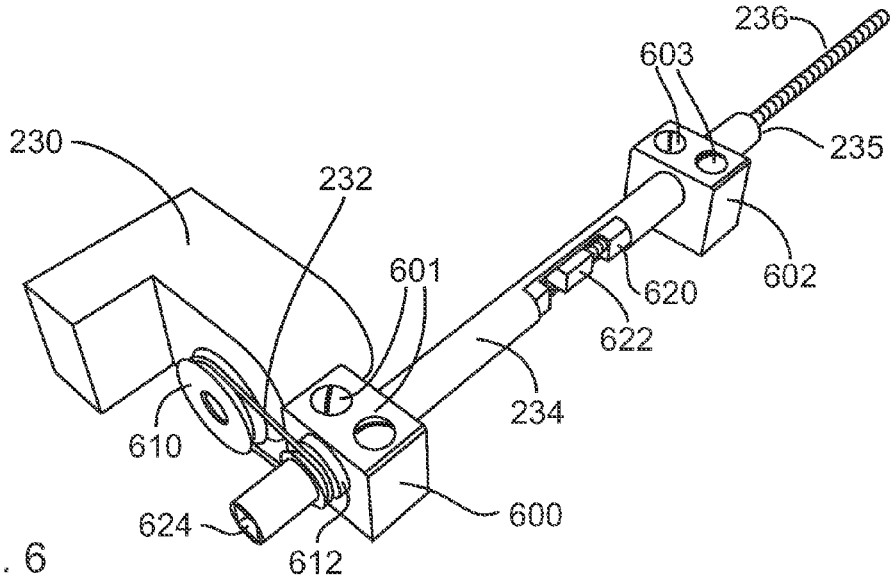
FIG. 6 is a perspective view of the power system for the snag tool.

FIG. 6 is a perspective view of the snag tool drive mechanism. Drive tube 234 is supported by bearing blocks 600 and 602 that allow the tube to freely turn. The bearing blocks are attached to chassis 202 shown in FIG. 2 by screws 601 and 603. Pulley 612 is attached to drive tube 234 by solder or adhesive. The interface between pulley 612 and bearing block 600 constrains drive tube 234 against pulling forces to the right. In the absence of a pulling force to the right, the drive tube is constrained by the force exerted by O-ring drive belt 232. Snag motor 230 rotates pulley 610 which drives belt 232 and causes drive tube 234 to rotate. The rotation may be in either direction. Drive tube 234 has a view cutaway section between the bearing blocks so that the interior structure is visible. A square tube 620 is attached to the inside of drive tube 234. Square tube 620 has a cutaway view so that drive block 622 can be seen. Drive block 622 is sized to slide freely inside square tube 620 and is attached to flexible shaft 236. The right end of drive tube 234 is capped by plug 235 which has a round hole large enough to allow the flexible shaft to slide in or out. The hole in plug 235 is small enough to prevent drive block 622 from passing through. The drive plug 622 and flexible shaft 236 are free to slide inside the square tube from the cap 235 on the right to the end 624 of the drive tube. The flexible shaft and drive block can be inserted and removed through end 624. When assembled, the right motor provides a stop that prevents the drive block 622 from disengaging from the square tube 620. This drive mechanism couples the flexible shaft 236 to the rotation provided by snag motor 230 while allowing the flexible shaft and drive block 622 to slide nearly the length of the drive tube 234. Pulling force on the flexible shaft when it at its extreme right position is transferred by drive block 622 to plug 235 to drive tube 234 to pulley 612 to bearing block 600 to the chassis 202.

Figure 7:
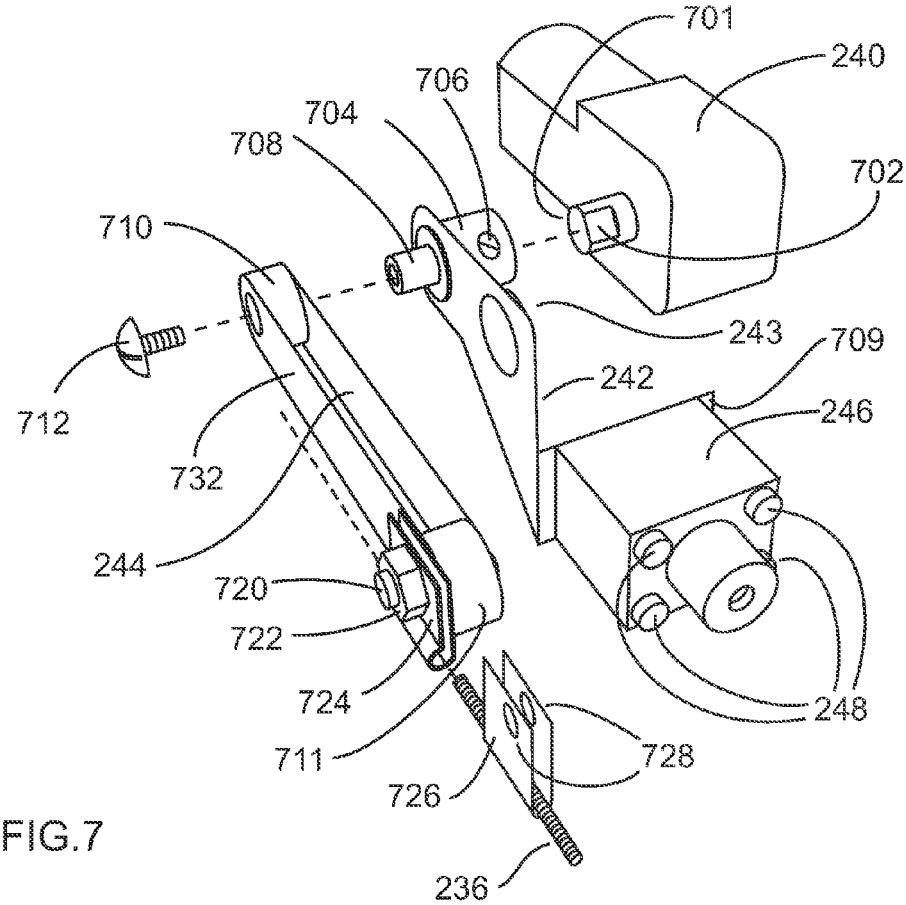
FIG. 7 is an exploded perspective view of the camera arm and snag arm.

FIG. 7 is an exploded perspective view of the camera arm and snag arm assembly. Coupler 704 slides over the drive shaft 701 of camera motor 240. Set screw 706 engages flat surface 702 to hold the coupler securely to the drive shaft 701. Camera arm 242 is attached using solder or adhesive to coupler 704. The camera arm has a tab 709 bent at 90 degrees attached to camera 246. LEDs 248 are attached to the camera. Coupler 704 has a shaft 708 that fits inside collar 710 such that the collar 710 can freely rotate about the shaft 708. Snag arms 244 and 732 are attached using solder or adhesive to collar 710 and collar 711. Collar 710 is constrained by screw 712 threaded into a matching threaded hole in shaft 708. After screw 712 is tightened, the assembled snag arm composed of collar 710, arms 244 and 732 and collar 711 can rotate freely rotate on shaft 708.

Flexible shaft 236 has an outer spiral winding of wire that forms a fine-pitched shallow thread. Sling 726 is made from knit fabric and interfaces with the flexible shaft. When a force is applied to the fabric to grip the flexible shaft, the fabric's thread loops grip the shallow threads so that rotating the flexible shaft exerts a force along the axis of the flexible shaft. Metal clamp 724 is shaped for a lose fit around the flexible shaft. The fabric sling 727 and flexible shaft 236 are placed inside clamp 724. Screw 720 passes through holes 728 in the fabric sling and through clamp 724. Nut 722 is used to adjust the force applied to the flexible shaft through the clamp and fabric. Nut 722 is adjusted to set the force of the fabric on the flexible shaft just strong enough to engage the threads on the flexible shaft. The force is set as weak as possible so that the flexible shaft is easy to rotate and can be pushed into or pulled out of the drive tube 234 by hand force. The flexible shaft extends forward when the snag motor 230 drives the flexible shaft 236 clockwise (when viewed from the front).

Figure 8:
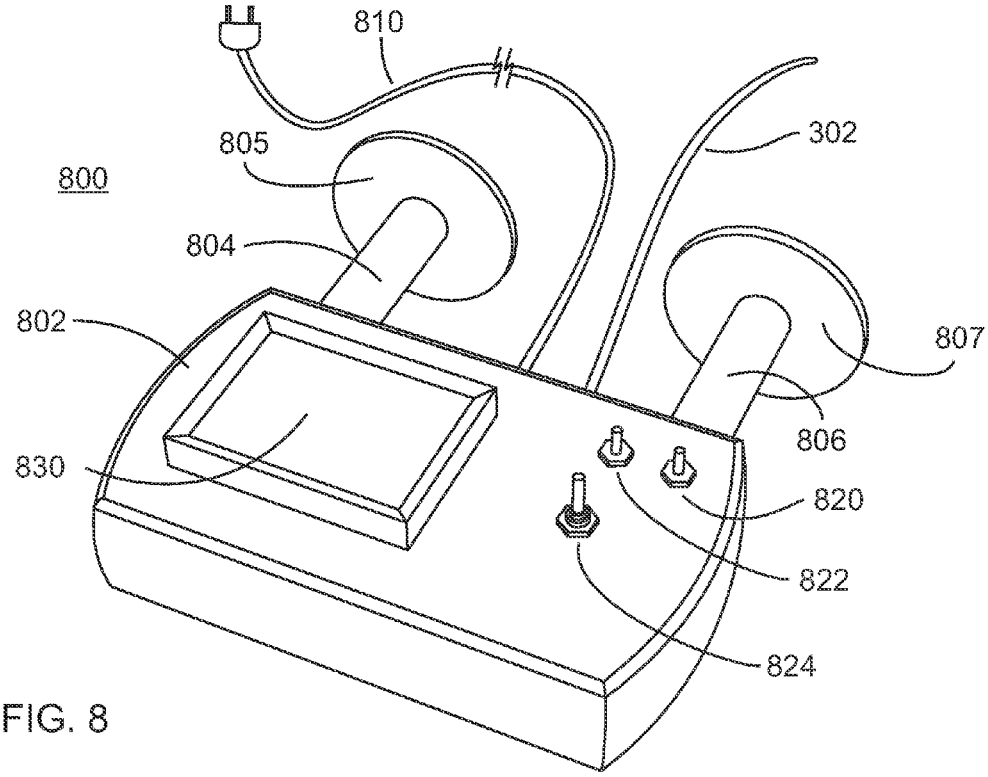
FIG. 8 is a perspective view of the remote command box.

FIG. 8 is a perspective view of the command box 800. The enclosure 802 provides the mounting surfaces for the controls and protection for the circuit components. Tether 302 and AC power cord 810 pass through the top side of enclosure 802. Posts 804 and 806 and discs 805 and 807 are structures for storing tether 302 and power cord 810. This is useful since the tether is typically 50 feet long. The tether storing structure is configured so that the tether can be wound in a figure-eight pattern which prevents twists as the tether is wound and unwound. Display 830 is a LCD (liquid crystal display) for viewing the image produced by camera 246.

Switch 820 controls the rotation of the camera arm. The switch has three positions and a SPDT switch action. The switch is held by a spring action such that no connections are made when no force is applied to the switch. The service technician can raise or lower the camera by holding the switch up or down until the camera reaches the desired position. When the switch is released, the camera position is held.

Switch 822 controls the snag tool. The switch has three positions and a SPDT switch action. Once placed in any of the three positions, the switch holds that position. Normally the switch is in its center position and no connections are made. The technician moves the switch to its upward position to drive the snag tool clockwise to extend and capture. The technician moves the switch to its downward position to drive the snag tool counter clockwise to retract. The technician moves the switch to its center position to stop snag tool rotation.

Joystick 824 is used to navigate the vehicle. The joystick interfaces to four switches that represent the commands of forward, reverse, turn left, and turn right. The joystick has a spring action that centers it when no force is applied, so no switch contacts are closed. The technician can manipulate the joystick to produce eight combinations of switch closures and corresponding motor actions:

1. Forward—both tracks drive forward
2. Reverse—both tracks drive reverse
3. Turn left—left track drives reverse and right track drives forward
4. Turn right—left track drives forward and right track drives reverse
5. Forward left—left track is off and right track drives forward
6. Forward right—left track drives forward and right track is off
7. Reverse left—left track is off and right track drives reverse
8. Reverse right—left track drives reverse and right track is off The technician navigates the vehicle by manipulating the joystick 824 while watching the display 830. Combinations 3 and 4 cause the vehicle to make pivot turns around its center. Combinations 5 through 8 cause the vehicle to make turns with a radius about equal to the length of the tracks.

Figure 9:
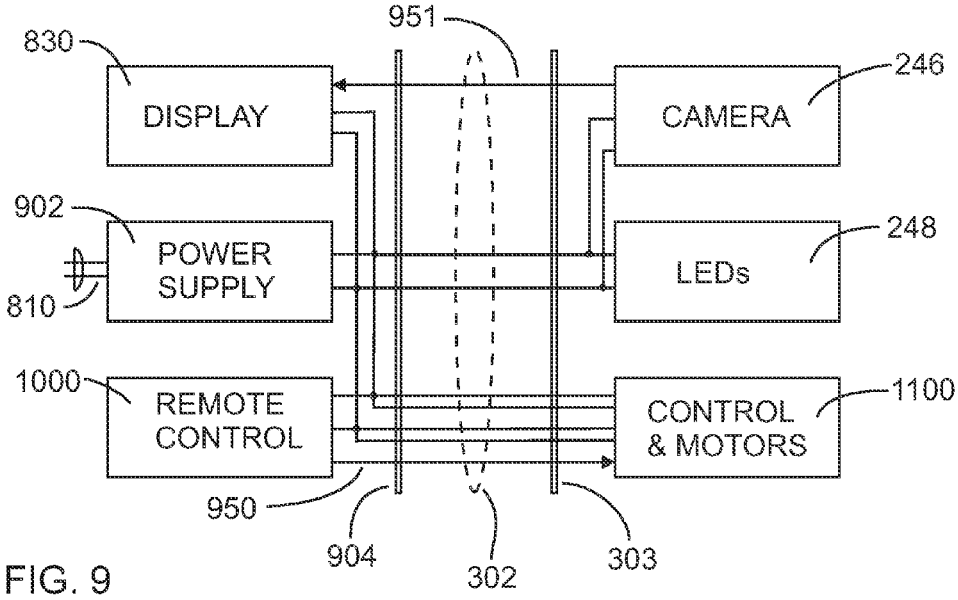
FIG. 9 is a block diagram of the command box and vehicle circuits.

FIG. 9 is a block diagram of the circuit components of command box 800 and the vehicle 200. The display 830, power supply 902 and power cord 810, and remote control circuits 1000 are part of the command box 800. The camera 246, LEDs 248, and control and motor circuit 1100 are part of the vehicle 200. Element 904 is a connector on the command box for connecting to tether 302. Element 303 is the connector on the vehicle PCB 301 shown in FIG. 3. Connectors 303 and 904 make connections to each of the eight wires in tether 302. Wire 950 carries the command signal to the vehicle. Wire 951 carries the video signal from the camera 246 to the display 830. A pair of wires carries power and ground for the camera and LEDs. Two pairs of wires carry power and ground for the motors and control. The separate power and ground supply for camera 246 and LEDs 248 isolates the video signal from noise induced by high current surges in the power and ground supply for the motors.

Figure 10:
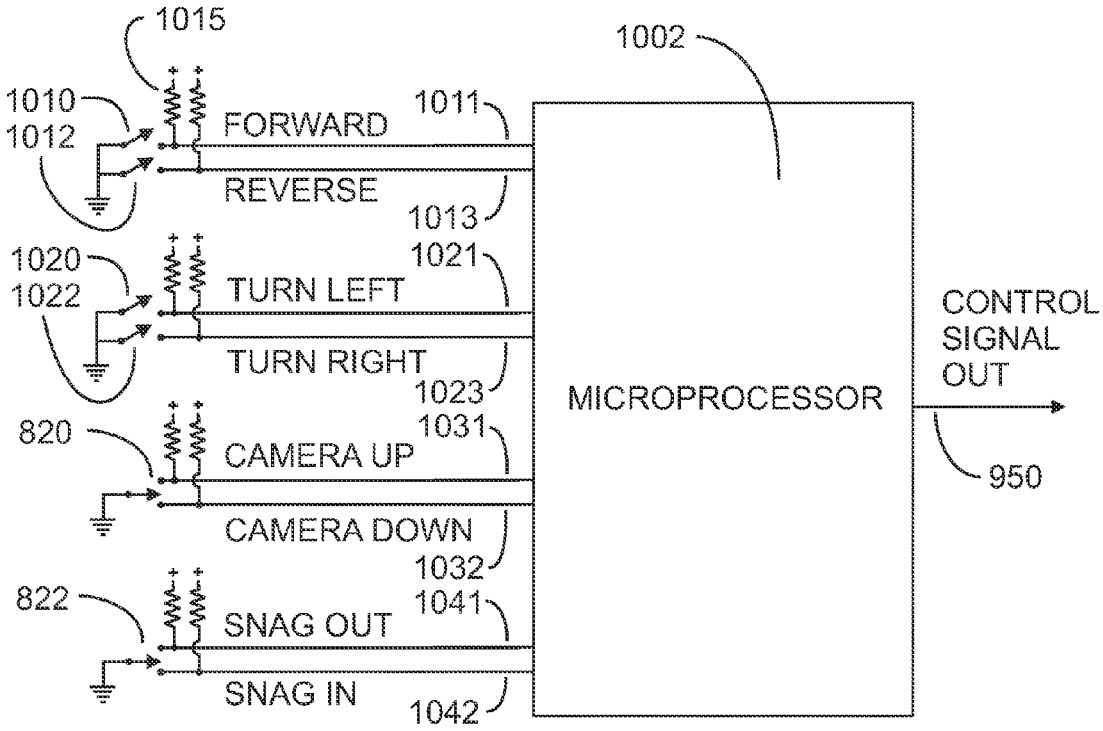
FIG. 10 is a schematic diagram of the command box circuit.

FIG. 10 is a schematic diagram of the circuit used to convert actions at the command box 800 into the control signal 950 sent to the vehicle. Microprocessor 1002 monitors the states switches 820, 822, and joystick 824 using eight inputs and generates the control signal. Several semiconductor companies supply suitable microprocessors. The preferred embodiment uses device PIC12F629 supplied by Microchip Technology Inc., 2355 West Chandler Blvd., Chandler, Ariz. 85224-6199. Each of the eight inputs to the microprocessor is connected to a high value resistor which is in turn connected to the positive power supply. For example, resistor 1015 connected to input 1011 ensures a high level is read when switch 1010 is open. These resistors ensure that the inputs will be read as a high when the switches are open. Switches 1010, 1012, 1020, and 1022 are part of joystick 824. Pushing the joystick forward causes switch 1010 to close, connecting the forward input 1011 to ground. This overcomes the high signal supplied by resistor 1015 so input 1011 is at a low level. Pushing the joystick rearward causes switch 1012 to close, connecting the reverse input 1012 to ground. Switch 1020 controls the state of the turn left input 1021. Switch 1022 controls the state of the turn right input 1023. The state of camera switch 820 controls the camera up input 1031 and the camera down input 1032. The state of snag switch 822 controls the snag out input 1041 and the snag in input 1042.

Figure 11:
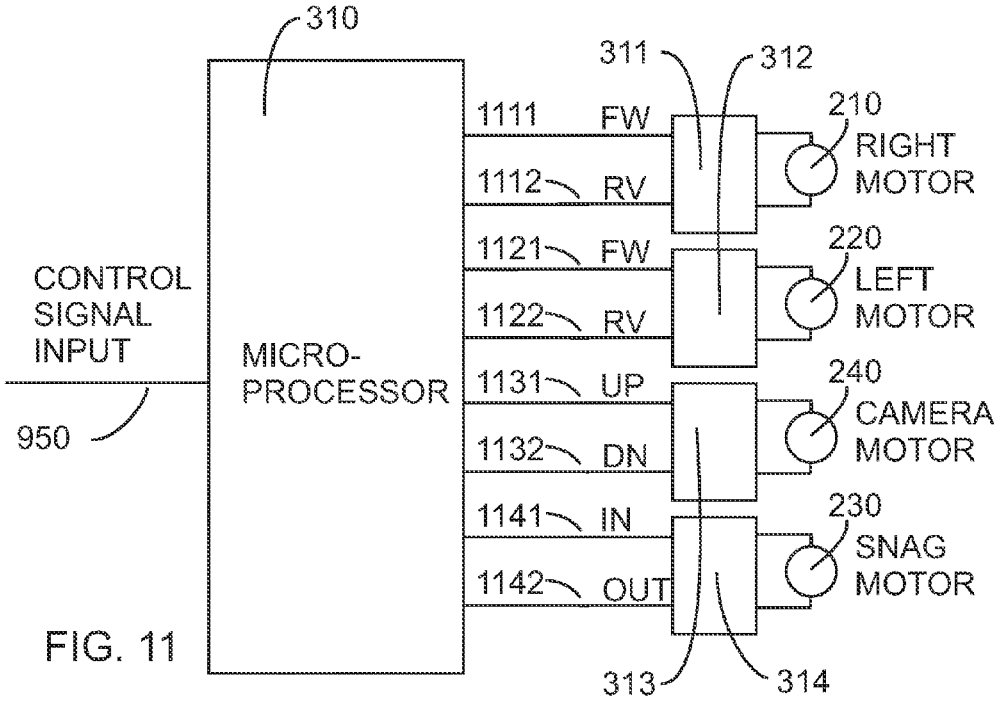
FIG. 11 is a schematic diagram of the vehicle motor control circuit.

FIG. 11 is a schematic diagram of the vehicle circuit that decodes the control signal 950. Microprocessor 310 processes signal 950 and produces two output control signals for each of the four motors. Several semiconductor companies supply suitable microprocessors. The preferred embodiment uses device PIC 12F629 supplied by Microchip Technology Inc., 2355 West Chandler Blvd., Chandler, Ariz. 85224-6199.

Several semiconductor suppliers provide suitable H-bridge circuits for driving the motors. The preferred embodiment uses model BD6225 supplied by Rohm Co., LTD., 21, Saiin Mizosaki-cho, Ukyo-ku, Kyoto 615-8585, Japan (www.rohm.com). H-bridge IC 311 drives the right motor 210. When outputs 1111 and 1112 are low, H-bridge 311 supplies no power to the right motor 210. When output 1111 is high, H-bridge 311 drives motor 210 such that the right track moves forward. When output 1112 is high, H-bridge 311 drives motor 210 such that the right track moves in reverse. Signals 1111 and 1112 are never high at the same time.

H-bridge IC 312 drives the left motor 220. When outputs 1121 and 1122 are low, H-bridge 312 supplies no power to the left motor 220. When output 1121 is high, H-bridge 312 drives motor 220 such that the let track moves forward. When output 1122 is high, H-bridge 312 drives motor 220 such that the left track moves in reverse. Signals 1121 and 1122 are never high at the same time.

H-bridge IC 313 drives the camera motor 240. When outputs 1131 and 1132 are low, H-bridge 313 supplies no power to the camera motor 240. When output 1131 is high, H-bridge 313 drives motor 240 such that the camera rotates upward. When output 1132 is high, H-bridge 313 drives motor 240 such that the camera rotates downward. Signals 1131 and 1132 are never high at the same time.

H-bridge IC 314 drives the snag motor 230. When outputs 1141 and 1142 are low, H-bridge 314 supplies no power to the snag motor 230. When output 1141 is high, H-bridge 314 drives snag motor 230 such that the snag tool rotates counter clockwise and is retracted. When output 1142 is high, H-bridge 314 drives motor 230 such that the snag tool rotates clockwise, and extends to capture a string or parachute. Signals 1141 and 1142 are never high at the same time.

Figure 12:
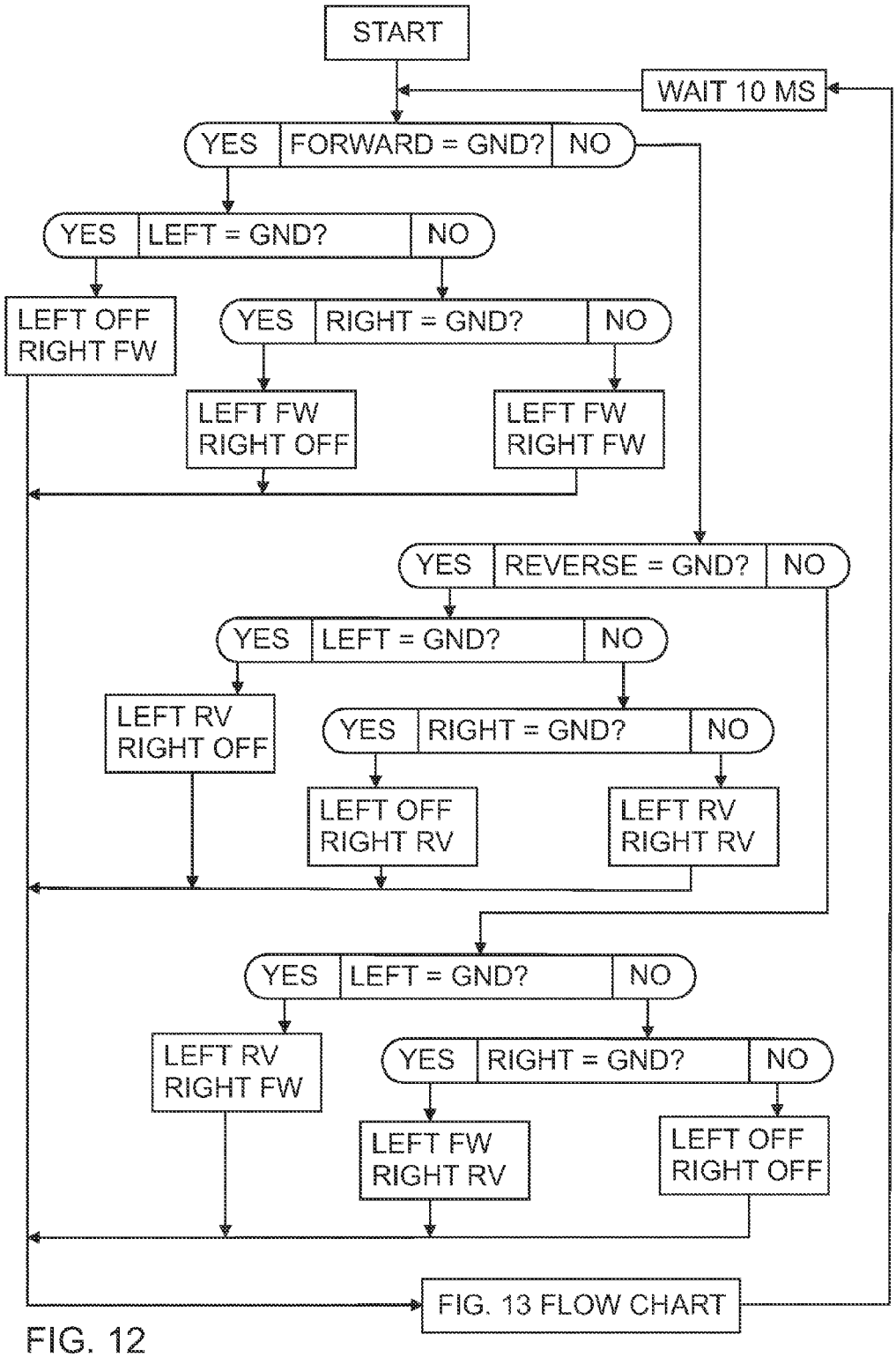
FIG. 12 is a flow chart of a portion of the command box logic.

FIG. 12 is a flow chart of the logic used by microprocessor 1002. Those ordinarily skilled in the art can translate such a flow chart into a program suitable for running on microprocessor 1002. The flow chart is the logic that reads the four joystick switches and encodes commands for the right motor 210 and left motor 220. Valid combinations of the four joystick switches 1010, 1012, 1020, and 1022 can produce a total of nine command combinations. In the flow chart, the four switches are called "FORWARD", REVERSE", "LEFT", and "RIGHT" and correspond respectively to signals 1011, 1013, 1021, and 1023 in FIG. 10. Each decision in the flow chart is base in on the state of one of these switches. Each command combination is represented by a box that contains the drive commands for the right motor 210 and left motor 220. For example, "LEFT FW" and "RIGHT RV" commands the left track 224 to drive forward and right track 214 to drive in reverse. This is the command for a pivot turn to the right.

Figure 13:
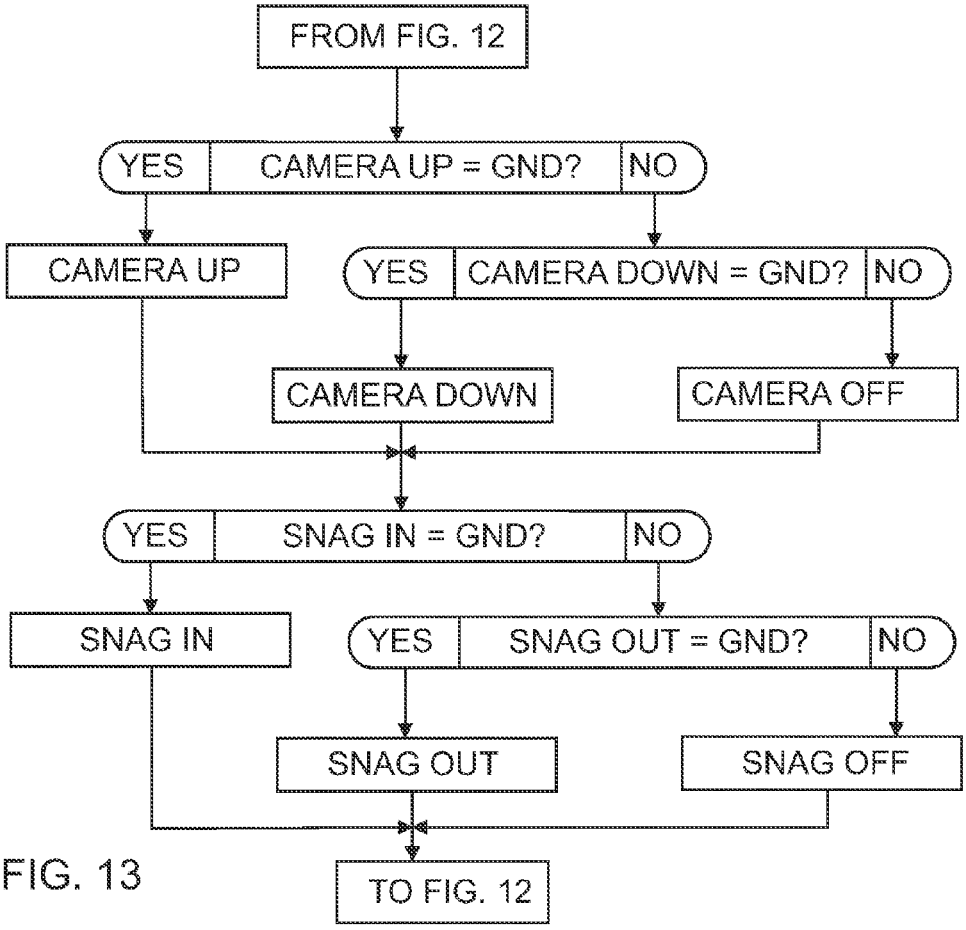
FIG. 13 is a flow chart of a portion of the command box logic.

The flow chart in FIG. 12 includes a box called "FIG. 13 FLOW CHART". That logic is shown in FIG. 13.

FIG. 13 is a flow chart of the logic used by microprocessor 1002 to read the camera control switch 820 and snag control switch 822. Each state of the camera control switch 820 is translated into three commands for the camera motor 240. These commands are "CAMERA UP", "CAMERA DOWN", and "CAMERA OFF". Each state of the snag control switch 822 is translated into three commands for the snag motor 230. These commands are "SNAG IN", "SNAG OUT", and "SNAG OFF".

Figure 14A:
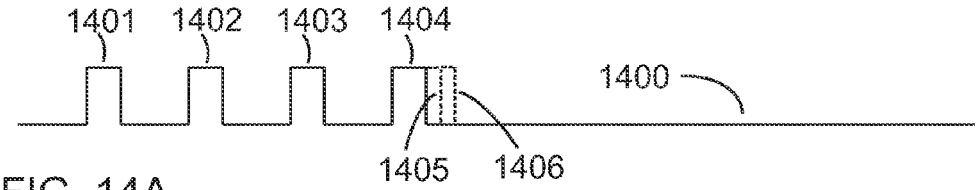
FIG. 14A is a timing diagram of the control signal from the command box to the vehicle.

FIG. 14A is a timing diagram of the control signal 950 generated by microprocessor 1002. The signal is a sequence of four pulses 1401, 1402, 1403, and 1404 followed by a long period 1400 of low level signal. Each pulse encodes the commands for one of the four motors: 1401 for right motor 210, 1402 for left motor 220, 1403 for camera motor 240, and 1404 for snag motor 230. Each pulse can have one of three discrete durations illustrated by pulse 1404. The short pulse 1404 corresponds to a command of snag motor off. The medium length pulse 1405 corresponds to the command of snag motor rotate counterclockwise to retract the snag tool. The long pulse 1406 corresponds to the command of snag motor rotate clockwise to extend snag tool. In the preferred embodiment, the short pulse duration is 1 ms, the medium duration is 1.5 ms, and the long duration is 2 ms. The separation between pulses is 2 ms and the long duration of the long low period is 10 ms. The command boxes in FIG. 12 and FIG. 13 control microprocessor output 950 such that the pulses have the proper durations and spaces as shown in FIG. 14A.

Figure 14B:
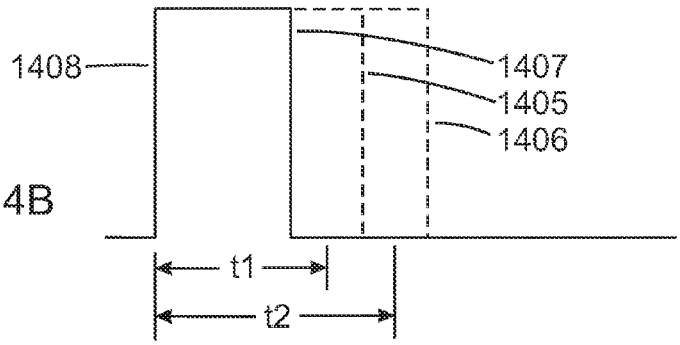
FIG. 14B is a timing diagram of a control pulse showing its three states.

FIG. 14B is a timing diagram of a single command pulse. The diagram shows time period t1 as the time between the leading edge 1408 of the pulse and the half way point between edge 1407 for a short pulse and edge 1405 for a medium pulse. The diagram shows t2 as the time between the leading edge 1408 of the pulse and halfway point between edge 1405 of a medium pulse and edge 1406 of a long pulse. The pulse is decoded by first measuring its duration, and then comparing its duration to t1 and t2. If the measured pulse duration is less than t1, then the pulse is determined to be a short pulse. If the measured pulse duration is greater than t2, then the pulse is determined to be a long pulse. If the measured pulse duration is more than t1 and less than t2, then the pulse is determined to be a medium duration pulse.

Figure 15:
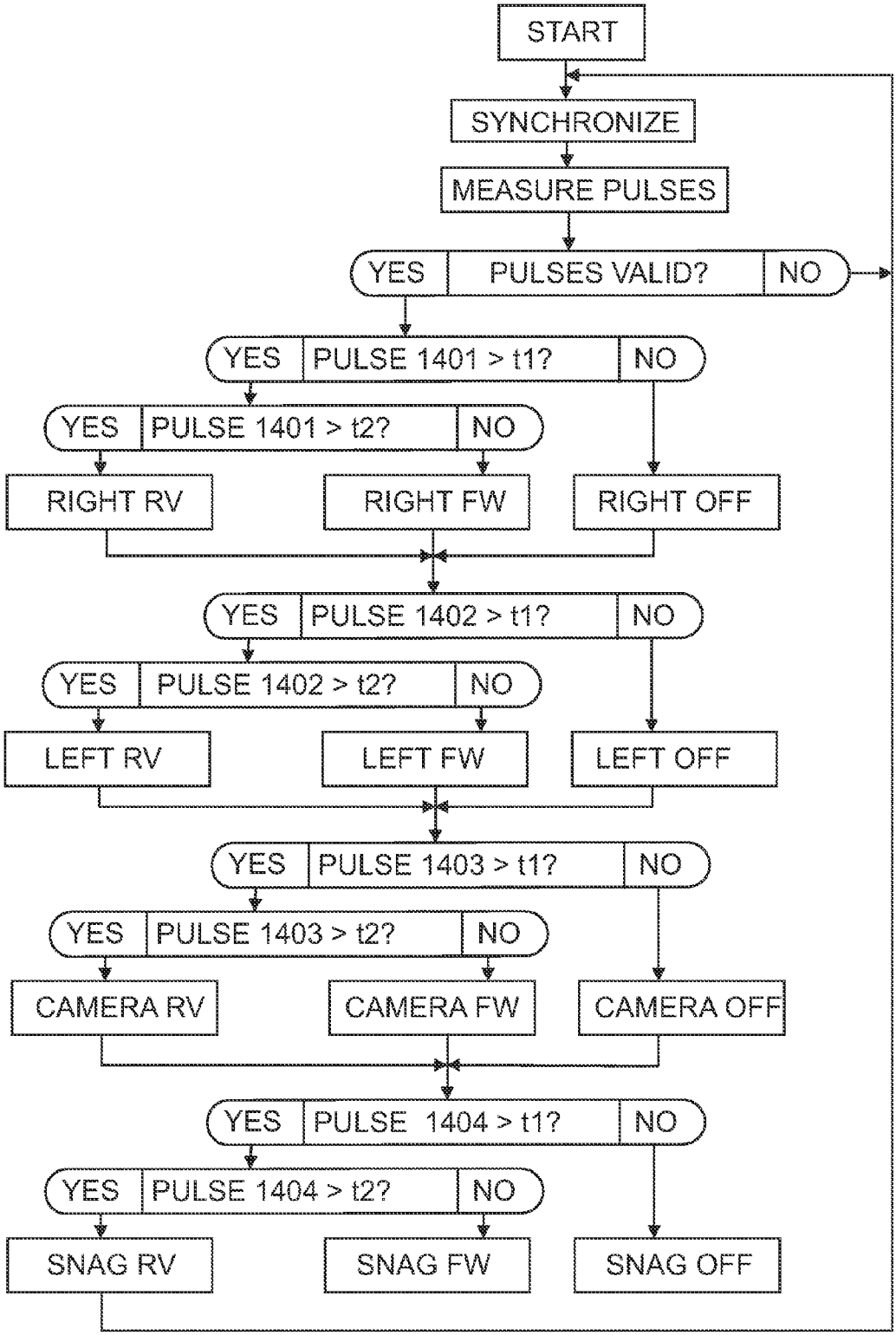
FIG. 15 is flow chart of the vehicle motor control logic.

FIG. 15 is a flow diagram of the logic in the microprocessor 310 used to decode the control signal 950. Those ordinarily skilled in the art can translate such a flow chart into a program suitable for running on the microprocessor. Synchronization is accomplished by waiting for a low level signal that lasts longer than the time between rising edges of the pulses. The duration of each pulse 1401, 1402, 1403, and 1404 is measured. The logic then compares the duration of each pulse to t1 and t2 to decode the command represented by each pulse. Then the corresponding output signals are set. The twelve boxes in the lower portion of FIG. 15 represent all valid combinations of commands that can be made. For example, the box containing "RIGHT RV" sets signal 1112 a high level and signal 1111 to a low level. This causes the right motor 210 to drive track 214 in reverse. The box containing "RIGHT FW" sets signal 1111 a high level and signal 1112 to a low level. This causes the right motor 210 to drive track 214 forward. The box containing "RIGHT OFF" sets signal 1111 and signal 1112 to a low level. This causes the right motor 210 to be off.

Conclusion

From the forgoing description, it will be apparent that there has been provided an improved remote controlled vehicle to assist in threading a string from a vent to a central plenum of a HVAC system. Variation and modification of the described vehicle, tether, and command box will undoubtedly suggest themselves to those skilled in the art. Accordingly, the forgoing description should be taken as illustrative and not in a limiting sense.

The various features illustrated in the figures may be combined in many ways, and should not be interpreted as though limited to the specific embodiments in which they were explained and shown. Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed:

1. A remote controlled vehicle to assist in threading a string through a HVAC duct system, comprising:

a. chassis for holding the components of said vehicle;

b. a means for propelling said vehicle in controllable directions in said duct system, said propelling means attached to said chassis;

c. a video camera attached to a camera arm, said camera arm rotated by a camera motor attached to said chassis;

d. a snag tool for snagging said string, said snag tool engaged by a snag arm detachably coupled to said camera arm, said snag tool controlled by a snag motor attached to said chassis;

e. a command box for remotely controlling said vehicle comprising:

a display for viewing images produced by said camera; and including interface means for generating command signals for remotely controlling said means for propelling said vehicle, and for generating command signals for controlling an elevation of said camera arm and said snag arm by said camera motor rotating said camera arm; and f. a tether for connecting said vehicle to a command box.

2. The remote controlled vehicle of claim 1 wherein said means for propelling comprises a left track and a right track, said left track driven by a left motor controlled by said command box, and said right track driven by a right motor controlled by said command box.

3. The remote controlled vehicle of claim 1 wherein said snag tool is attached to an extendable flexible shaft.

4. The remote controlled vehicle of claim 3 wherein said snag tool controlled by said snag motor comprises said snag motor rotating said shaft to extend said snag tool, wherein said snag motor is controlled by said command box.

5. The remote controlled vehicle of claim 1 wherein said tether comprising a conductor for providing power to said vehicle, a conductor for carrying said command signals, and a conductor for carrying said images produced by said camera.

6. The remote controlled vehicle of claim 1 wherein said interface means comprises a joystick, whereby moving said joystick generates a plurality of commands for propelling said vehicle in said controllable directions.

7. A remote controlled vehicle to assist in threading a string through a HVAC duct system, comprising:

a. a means for propelling said vehicle in controllable directions in said duct system;

b. a video camera attached to said vehicle;

c. a means for changing an orientation of said camera;

d. a snag tool attached to said vehicle;

e. a means for rotating said snag tool;

f. a means for changing the orientation of said snag tool;

g. a command box for remotely controlling said vehicle;

h. a tether for connecting said vehicle to said command box;

i. said command box including a display for viewing images produced by said camera;

j. said command box including interface means for generating command signals for controlling said means for propelling said vehicle in said controllable directions;

k. said command box including interface means for generating command signals for controlling said means for changing the orientation of said camera;

l. said command box including interface means for generating command signals for controlling said means for rotating said snag tool.

8. The remote controlled vehicle of claim 7, wherein said means for changing the orientation of said camera is detachably coupled to said means for changing the orientation of said snag tool, and wherein said command box including interface means for generating command signals for controlling said means for changing the orientation of said camera comprises said command box including interface means for generating a single set of command signals for controlling both said means for changing the orientation of said camera and said means for changing the orientation of said snag tool.

* * * * *